US010755684B1

(12) United States Patent
Steinkraus

(10) Patent No.: US 10,755,684 B1
(45) Date of Patent: Aug. 25, 2020

(54) SQUEAKER ARRANGEMENT PRODUCING VARIABLE SOUNDS

(71) Applicant: Gramercy Products, Inc., Secaucus, NJ (US)

(72) Inventor: William Steinkraus, Fort Lee, NJ (US)

(73) Assignee: Gramercy Products, Inc., Secaucus, NJ (US)

( * ) Notice: Subject to any disclaimer, the term of this patent is extended or adjusted under 35 U.S.C. 154(b) by 0 days.

(21) Appl. No.: 16/378,818

(22) Filed: Apr. 9, 2019

(51) Int. Cl.
*G10K 3/00* (2006.01)
*G10K 15/04* (2006.01)
*A63H 5/00* (2006.01)

(52) U.S. Cl.
CPC ..... *G10K 3/00* (2013.01); *A63H 5/00* (2013.01); *G10K 15/04* (2013.01)

(58) Field of Classification Search
CPC ..... A63H 5/00; G10K 3/00; G10K 15/04; G10K 5/00
See application file for complete search history.

(56) References Cited

U.S. PATENT DOCUMENTS

| | | | |
|---|---|---|---|
| 277,581 | A | 5/1883 | Leggett |
| 455,671 | A | 7/1891 | Sellers |
| 831,392 | A | 9/1906 | Warfel |
| 1,039,814 | A | 10/1912 | Sacavem |
| 1,453,527 | A | 5/1923 | Schneider |
| 1,466,877 | A | 9/1923 | Grubman |
| 1,503,518 | A | 8/1924 | Schneider |
| 1,515,477 | A | 11/1924 | Grubman |
| 1,565,723 | A | 12/1925 | Evans |

(Continued)

FOREIGN PATENT DOCUMENTS

| | | |
|---|---|---|
| CA | 551365 | 1/1958 |
| GB | 850524 | 10/1960 |

(Continued)

OTHER PUBLICATIONS

"Press Fit Engineering and Design Calculator," Feb. 27, 2019, available at: www.engineersedge.com/calculators/machine-design/press-fit/press-fit-calculator.htm.

*Primary Examiner* — Eugene L Kim
*Assistant Examiner* — Alyssa M Hylinski
(74) *Attorney, Agent, or Firm* — Thomas A. O'Rourke; Bodner & O'Rourke, LLP

(57) ABSTRACT

A sound producing device includes: a housing and carriage. The housing has a cylindrical interior surface with a helical tracking thread protruding therefrom. The cylindrical carriage has an opening in its exterior surface defining a helical shaped recess that receives and tracks along the helical housing thread. A squeaker may be secured within the carriage, so when air flows in a first direction through the housing, it emits sound, and the squeaker carriage is driven to track along the helical thread, causing the carriage to rotate and also translate in the first direction, according to a pitch of the helical thread. A frequency of the sound produced by the squeaker changes according to the carriage's translational movement, as it changes the dimensions of the sound-producing chamber. When air subsequently flows through the housing in the opposite direction, the carriage's motion is reversed, correspondingly changing the frequency of sound produced.

14 Claims, 6 Drawing Sheets

(56) References Cited

U.S. PATENT DOCUMENTS

| | | | | | |
|---|---|---|---|---|---|
| 1,588,356 | A | | 6/1926 | Grubman | |
| 1,590,188 | A | | 6/1926 | Grubman | |
| 1,609,073 | A | | 11/1926 | Evans | |
| 1,642,956 | A | | 9/1927 | Hutnikow | |
| 1,667,093 | A | | 4/1928 | Aronson | |
| 1,667,353 | A | | 4/1928 | Lloyd | |
| 1,883,724 | A | | 10/1932 | Grubman | |
| 1,967,818 | A | | 7/1934 | Gershowitz | |
| 2,259,467 | A | | 10/1941 | Henry | |
| 2,299,023 | A | | 10/1942 | Marcus | |
| 2,302,318 | A | | 11/1942 | Henry | |
| 2,462,576 | A | * | 2/1949 | Walker | A63H 1/00 446/241 |
| 2,485,142 | A | | 10/1949 | Duncan | |
| 2,558,237 | A | | 6/1951 | Cohn | |
| 2,583,402 | A | | 1/1952 | Wilhelm | |
| 2,608,796 | A | * | 9/1952 | Bicocchi | 446/208 |
| 2,667,718 | A | | 2/1954 | Wilhelm | |
| 2,712,201 | A | | 7/1955 | Wintriss | |
| 2,836,928 | A | | 6/1958 | Ragazzo | |
| 2,840,033 | A | | 6/1958 | Nitchman | |
| 3,029,555 | A | | 4/1962 | Lemelson | |
| 3,032,920 | A | | 5/1962 | Cohn | |
| 3,032,921 | A | * | 5/1962 | Greene | A63H 3/48 446/190 |
| 3,093,928 | A | | 6/1963 | Ostrander | |
| 3,137,504 | A | | 6/1964 | Zordan | |
| 3,138,895 | A | | 6/1964 | Gausewitz | |
| 3,172,232 | A | | 3/1965 | Bischoff | |
| 3,296,736 | A | | 1/1967 | Kaplan | |
| 3,298,129 | A | | 1/1967 | Katz | |
| 3,303,605 | A | | 2/1967 | Henry | |
| 3,350,811 | A | * | 11/1967 | Bender | A63H 33/00 446/117 |
| 3,413,756 | A | | 12/1968 | Gardel | |
| 3,638,351 | A | | 2/1972 | Kosicki | |
| 4,030,472 | A | * | 6/1977 | Watkins | A63H 27/12 124/5 |
| 4,274,631 | A | | 6/1981 | Hayazaki | |
| 4,279,100 | A | | 7/1981 | Rivette | |
| 4,443,201 | A | * | 4/1984 | Diefenbach | A63H 5/00 434/259 |
| 4,609,196 | A | * | 9/1986 | Bozinovic | A63B 43/04 446/437 |
| 5,133,551 | A | | 7/1992 | Handy | |
| 5,169,153 | A | | 12/1992 | Levy | |
| 5,306,193 | A | * | 4/1994 | Yang | A63B 21/0608 446/215 |
| 5,533,757 | A | * | 7/1996 | Morris | A63H 5/00 281/15.1 |
| 5,553,757 | A | | 9/1996 | Wang | |
| 5,590,875 | A | * | 1/1997 | Young | A63B 15/005 473/457 |
| 5,820,437 | A | | 10/1998 | Coleman | |
| 6,068,534 | A | | 5/2000 | Strongin | |
| 6,892,674 | B1 | * | 5/2005 | Dubinins | A01K 15/026 119/702 |
| 9,370,167 | B2 | | 6/2016 | Vap | |
| 9,486,685 | B2 | | 11/2016 | Rambo | |
| 9,579,582 | B2 | * | 2/2017 | Irie | A63H 33/18 |
| 2002/0086608 | A1 | * | 7/2002 | Chu | A63H 5/00 446/200 |

FOREIGN PATENT DOCUMENTS

| | | | |
|---|---|---|---|
| GB | 2 339 154 | | 1/2000 |
| JP | S5946595 | U | 3/1984 |
| JP | H04111394 | | 9/1992 |
| JP | H05194 | U | 1/1993 |
| JP | H0541590 | U | 6/1993 |
| JP | H0634660 | U | 5/1994 |
| JP | 3002155 | U | 9/1994 |
| JP | 3004028 | U | 11/1994 |
| JP | H071961 | | 1/1995 |
| JP | H0838745 | A | 2/1996 |
| JP | 6409186 | B2 | 10/2018 |

* cited by examiner

SQUEAKER ARRANGEMENT PRODUCING VARIABLE SOUNDS

FIELD OF THE INVENTION

The subject technology relates generally to squeakers for child and animal toys, and more particularly to an improved squeaker arrangement in which the sound produced varies as the sound is being emitted.

BACKGROUND OF THE INVENTION

Sound-producing devices that use a reed and which produce a changing sound are known in the art, and are referred to variously as, for example, a sounding reed, a voice for toys, a talking toy mechanism, etc.

For example, U.S. Pat. No. 1,453,527 to Schneider teaches the use of a plunger that moves to force air through a reed, and the further use of a valve that interrupts the air flow to produce two separate consecutive sounds that mimic a child's uttering of "ma-ma."

U.S. Pat. No. 1,590,188 to Grubman uses a reed applied to a weighty bellows head that undergoes a gravity descent to cause air to be expelled under pressure through a channel to cause vibrations and sound production.

U.S. Pat. No. 1,642,956 to Hutnikow similarly uses a reed of well-known construction and a weighted disk that translates linearly within a tube to force air over the tube to generate sound.

U.S. Pat. No. 1,888,724 to Grubman discloses a reed supported in a plug that is placed within and fills up a tube in which it slides to cause air to flow and produce sounds.

The herein disclosed sound-producing arrangement is unique and improves upon the prior art devices.

It is noted that citing herein of any patents, published patent applications, and non-patent literature is not an admission as to any of those references constituting prior art with respect to the disclosed apparatus.

OBJECTS OF THE INVENTION

It is an object of the invention to provide a squeaker device for a toy.

It is another object of the invention to provide a squeaker on a movable carriage to change a pitch of the sounds produced.

It is a further object of the invention to provide a squeaker on a movable carriage for use in a toy, in which the carriage does not just translate.

It is another object of the invention to provide a squeaker on a carriage that moves about a helical thread in the housing to slow down the motion of the carriage.

It is also an object of the invention to provide a squeaker on a carriage that translates and rotates to slow down the motion of the carriage.

Further objects and advantages of the invention will become apparent from the following description and claims, and from the accompanying drawings.

SUMMARY OF THE INVENTION

This Summary is provided to introduce a selection of concepts in a simplified form that are further described below in the Detailed Description. This Summary is not intended to identify key features or essential features of the claimed subject matter, nor is it intended to be used to limit the scope of the claimed subject matter.

In accordance with at least one embodiment of the disclosed apparatus, a sound producing device may broadly include: a housing, and a carriage.

In a first embodiment, the housing may have a cylindrical interior surface with a helical tracking thread protruding therefrom. The cylindrical carriage may have an opening in its exterior surface defining a helical shaped recess that receives and tracks along the helical housing thread. A squeaker may be secured within the carriage, so that when air flows in a first direction through the housing, the squeaker emits sound, and the squeaker carriage is also thereby driven to track along the helical thread, causing the carriage to rotate and to also translate in the first direction, with such rotation and translation being according to a pitch of the helical thread and the corresponding recess. A frequency of the sound produced by the squeaker changes according to the carriage's translational movement, as such movement changes the dimensions of the sound-producing chamber. When air subsequently flows through the housing in the opposite direction, the carriage's motion is reversed, correspondingly changing the frequency of the sound produced. (i.e., lower frequency to higher frequency)

In general, when the carriage tracks toward a distal end of the housing and away from the air source (e.g., in the first direction being away from an air-filled bladder), the sounds produced by the squeaker continuously changes its pitch with continuous carriage movement in the first direction. Similarly, when the carriage tracks away from the air source (e.g., in the first direction being away from an air-filled bladder), the sounds produced by the squeaker continuously changes in pitch with continuous carriage movement in the second direction.

The interior surface of the housing is preferably a cylindrical surface, and the exterior surface of the squeaker carriage is also preferably a cylindrical surface that is particularly sized to slide with respect to the cylindrical interior surface of the housing. The exterior cylindrical surface of the squeaker carriage may be particularly sized to slide with respect to the cylindrical interior surface of the housing in a loose clearance fit (i.e., a free running fit), or more preferably may slide respect to the cylindrical interior surface of the housing using a close clearance fit. Alternatively, a very slight friction fit may be used, which friction may be so slight as to not prohibit movement of the carriage by the air pressure produced by the toy in which the device is installed.

A second embodiment may be similar to the first embodiment, except that the housing may have a cylindrical interior surface with first and second helical tracking threads protruding therefrom (i.e., the threads from a double helix), and the cylindrical carriage may have corresponding first and second openings in its exterior surface defining first and second helical shaped recesses that receive and track along the first and second housing threads.

BRIEF DESCRIPTION OF THE DRAWINGS

The description of the various example embodiments is explained in conjunction with appended drawings, in which.

DETAILED DESCRIPTION OF THE INVENTION

Figure 1:
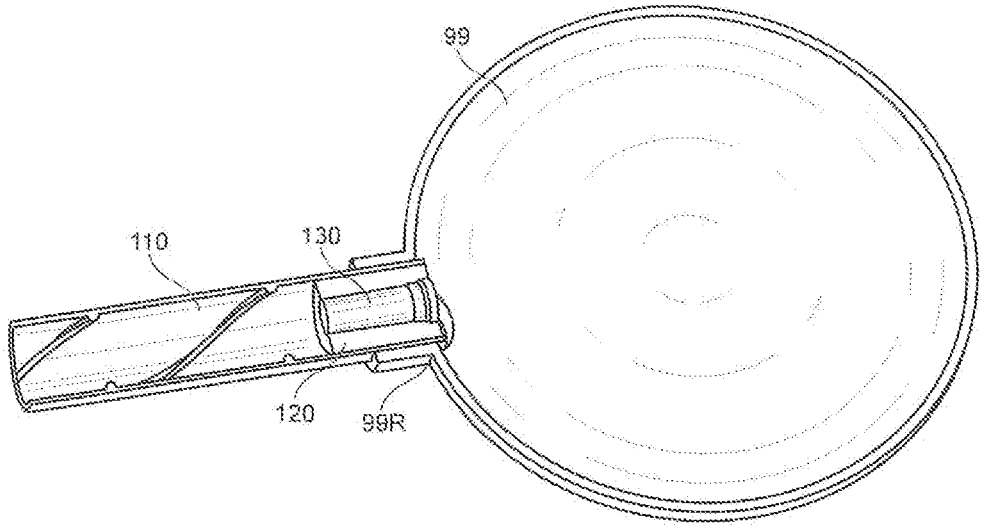
FIG. 1 illustrates a cut-away perspective view of the herein disclosed squeaker assembly being used in combination with an air bladder as an air source.
Figure 3:
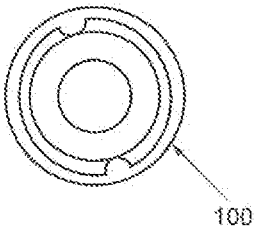
FIG. 3 is a top view of the squeaker assembly of FIG. 2.
Figure 2:
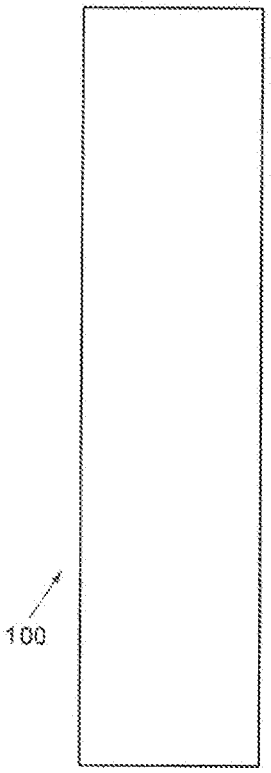
FIG. 2 is a side view of the squeaker assembly shown in FIG. 1.

As used throughout this specification, the word "may" is used in a permissive sense (i.e., meaning having the potential to), rather than a mandatory sense (i.e., meaning must), as more than one embodiment of the invention may be disclosed herein. Similarly, the words "include", "including", and "includes" mean including but not limited to.

The phrases "at least one". "one or more", and "and/or" may be open-ended expressions that are both conjunctive and disjunctive in operation. For example, each of the expressions "at least one of A, B and C", "one or more of A, B, and C", and "A, B, and/or C" herein means all of the following possible combinations: A alone; or B alone; or C alone; or A and B together; or A and C together; or B and C together; or A, B and C together.

Also, the disclosures of all patents, published patent applications, and non-patent literature cited within this document are incorporated herein in their entirety by reference. However, it is noted that citing herein of any patents, published patent applications, and non-patent literature is not an admission as to any of those references constituting prior art with respect to the disclosed apparatus.

Furthermore, the described features, advantages, and characteristics of any particular embodiment disclosed herein, may be combined in any suitable manner with any of the other embodiments disclosed herein.

Additionally, any approximating language, as used herein throughout the specification and claims, may be applied to modify any quantitative or qualitative representation that could permissibly vary without resulting in a change in the basic function to which it is related. Accordingly, a value modified by a term such as "about" is not to be limited to the precise value specified, and may include values that differ from the specified value in accordance with applicable case law. Also, in at least some instances, a numerical difference provided by the approximating language may correspond to the precision of an instrument that may be used for measuring the value. A numerical difference provided by the approximating language may also correspond to a manufacturing tolerance associated with production of the aspect/feature being quantified. Furthermore, a numerical difference provided by the approximating language may also correspond to an overall tolerance for the aspect/feature that may be derived from variations resulting from a stack up (i.e., the sum) of a multiplicity of such individual tolerances.

Any use of a friction fit (i.e., an interface fit) between two mating parts described herein indicates that the opening (e.g., a hole) is smaller than the part received therein (e.g., a shaft), which may be a slight interference fit in one embodiment in the range of 0.0001 inches to 0.0003 inches, or an interference of 0.0003 inches to 0.0007 inches in another embodiment, or an interference of 0.0007 inches to 0.0010 inches in yet another embodiment, or a combination of such ranges. Other values for the interference may also be used in different configurations (see e.g., "Press Fit Engineering and Design Calculator," available at: www.engineersedge.com/calculators/machine-design/press-fit/press-fit-calculator.htm).

Any described use of a clearance fit indicates that the opening (e.g., a hole) is larger than the part received therein (e.g., a shaft), enabling the two parts to move (e.g. to slide and/or rotate) when assembled, where the gap between the opening and the part may depend upon the size of the part and the type of clearance fit (e.g., for a 0.1250 inch shaft diameter the opening may be 0.1285 inches for a close fit and may be 1360 inches for a free (running) fit; and for a 0.5000 inch diameter shaft size the opening may be 0.5156 inches for a close clearance fit and may be 0.5312 inches for a free clearance fit). Other clearance amounts may also be used.

In accordance with at least one embodiment, as seen in FIG. 1, a sound producing device 100 may broadly include: a housing 110, a carriage 120, and a squeaker 130. The sound producing device 100 may be used in many different toys and toy configurations. In FIG. 1, the sound producing device 100 is shown being used in conjunction with a resilient air bladder 99 merely to be illustrative. In this arrangement, the air bladder 99 may be used (i.e., may be squeezed) to expel air in a first direction through the housing 110, and may subsequently be released for the resilient bladder to naturally expand and draw air into the housing in a second (opposite) direction.

For the sound producing device 100, the housing 110 may extend from a first end 111 to a second end 112, and may have an interior surface 113 that may preferably be cylindrical. The housing may also have a cylindrical exterior surface 113E. A helical tracking thread 114 may be formed to protrude into the hollow interior of the housing 110. The helical tracking thread 114 may protrude from the interior surface 113 of the housing 110 beginning at the first end 111 and ending at the second end 112 of the housing. The helical tracking thread 114 may be formed in accordance with any suitable thread standards known in the art, including, but not limited to, Unified National Coarse threading (UNC), Unified National Tine threading (UNF), Unified National Extra Fine threading (UNEF), Unified National Special threading (UNS), Unified National Round threading (UNR), etc.

Figure 4:
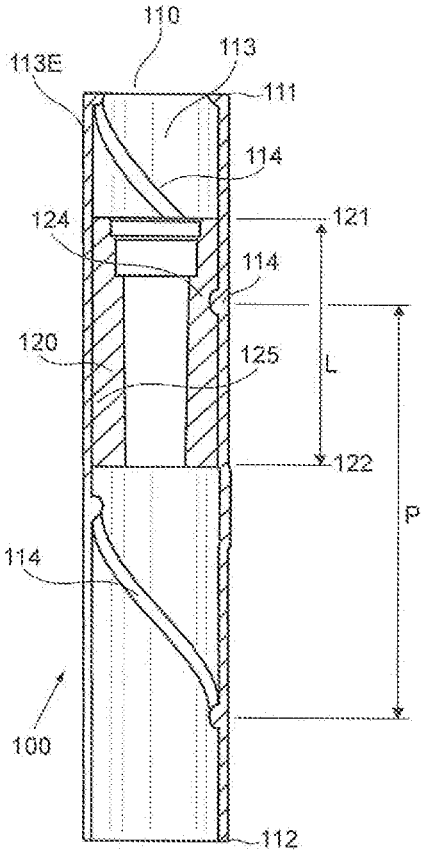
FIG. 4 is a cross-sectional view through the squeaker assembly of FIG. 3.
Figure 6:
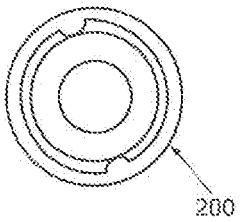
FIG. 6 is a top view of the squeaker assembly of FIG. 5.
Figure 5:
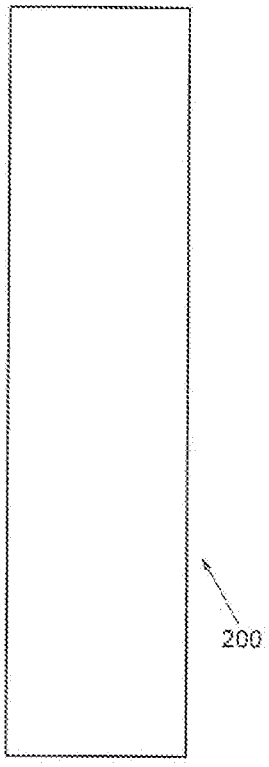
FIG. 5 is a side view of an alternate embodiment of the squeaker assembly shown within FIG. 1.
Figure 7:
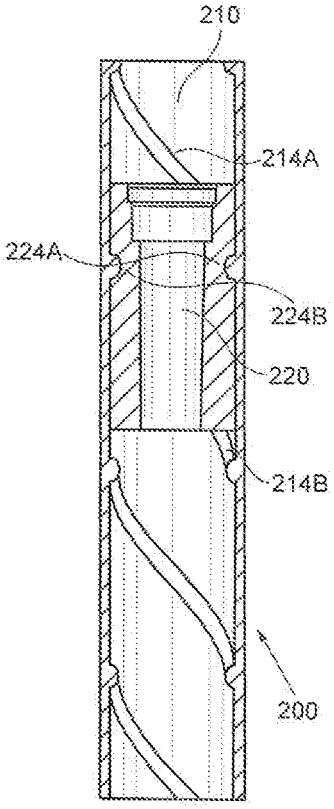
FIG. 7 is a cross-sectional view through the squeaker assembly of FIG. 6.
Figure 7A:
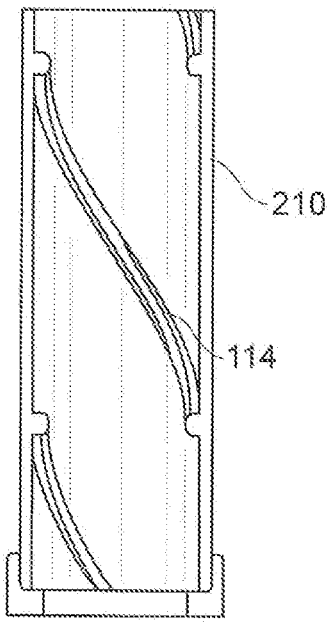
FIG. 7A is the cross-sectional view of FIG. 4, shown with an end cap positioned on one end of the housing to prevent travel of the carriage out from the housing.
Figure 7B:
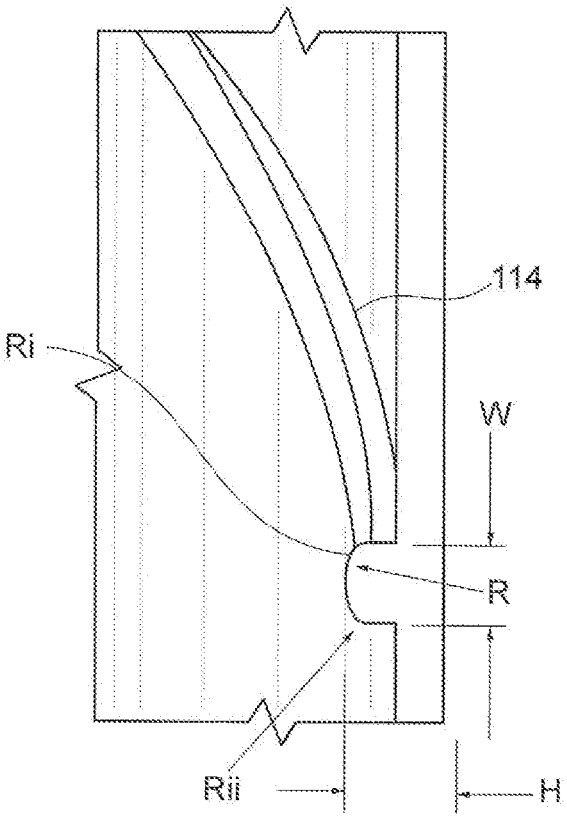
FIG. 7B is an enlarged detail view of the helical thread shown in FIG. 4.

However, to better enable relative movement of the carriage, the helical tracking thread 114 may be uniquely formed. The helical tracking thread 114 may be formed to extend to a height H into the hollow cavity of the housing and have a width W, as seen in FIG. 4A. The peak of the thread may be formed having a true radius R that may transition into the straight side walls (in cross-section) of the width W using a first (smaller) transition radius Ri and a second transition radius Rii. Moreover, to facilitate relatively easily initiated sliding of the carriage due to small loads imposed by a very slight air flow rate tfrom a bladder in a toy, not only would the mass of the squeaker assembly be small, but the pitch P of the helical thread would preferably be substantially larger than the cross-sectional width W of the helical tracking thread 114. In one embodiment, the ratio of the pitch P to the cross-sectional width W of the helical tracking thread 114 may be at least in the range of 3-10. In another embodiment, the ratio of the pitch P to the cross-sectional width W of the helical tracking thread 114 is preferably at least in the range of 10-20. In another embodiment, the ratio of the pitch P to the cross-sectional width W of the helical tracking thread 114 is more preferably at least in the range of 20-30. Other ratios may be used in other embodiments. It may be understood that the larger the ratio, the smaller will be the normal force that is imposed on the helical tracking thread 114 by the carriage 120, as a result of the air load (thrust) imposed on the carriage, which is turn reduces both the static friction force and the sliding friction therebetween, which facilitates easier relative motion of the carriage. It may also be understood that the greater the ratio the faster the carriage will travel along the helical tracking thread 114, as a result of having to make fewer turns, as it travels along a shorter path.

The carriage 120 may be substantially cylindrical, and may extend from a first end 121 to a second end 122, which ends may be substantially flat. The carriage 120 may have a cylindrical outer surface 123 with an opening in that exterior surface that defines a helical shaped recess 124 (see FIG. 4 and FIG. 8). The helical shaped recess 124 is shaped to correspond to the dimensions of the helical tracking thread 114 of the housing 110 such that it may receive the helical housing thread therein (see FIG. 4). The carriage 120 may be threaded onto the housing when being initially assembled. In one embodiment, the helical shaped recess 124 in the carriage 120 may be shaped to receive the helical housing thread 114 therein in a slight (close) clearance fit. In another embodiment, which may better facilitate ease in sliding of the carriage with respect to the thread, the helical shaped recess 124 in the carriage 120 is more preferably shaped to receive the helical housing thread 114 therein in a free (running) fit.

Also, the length L of the carriage 120 between its substantially flat first end 121 and substantially flat second end 122 may preferably be coordinated with the pitch P of the helical housing thread 114. In one embodiment, the length L may be in the range of 20 percent to 40 percent of the pitch P of the helical housing thread 114, which would generally ensure engagement of the length L of the carriage with a corresponding portion of one complete turn (360 degrees) of a housing thread (i.e., about 20% to 40% of one single thread). In another embodiment, the length L may be in the range of 40 percent to 80 percent of the pitch P of the helical housing thread 114, which would generally ensure engagement of the length L of the carriage with a corresponding portion of one complete turn of a housing thread (i.e., about 40% to 80% of one single thread). It is noted that the carriage 120 shown in FIG. 4 has a length that is about 58 percent of the pitch P of the thread illustrated therein, merely to be illustrative. In general, the smaller the amount of the helical housing thread 114 that is engaged by the carriage 120, the more asymmetric may tend to be the loading between the carriage and the thread, which may tend to cause the carriage to hang up or not have a continuous smooth motion. Therefore, in yet another embodiment, the length L may be in the range of 80 percent to 120 percent of the pitch P of the helical housing thread 114, which would generally ensure engagement of the length L of the carriage with a corresponding portion of one complete turn (360 degrees) of a housing thread (i.e., about 80% to 120% of one single thread). In this last embodiment, as the length of the the carriage 120 is formed to be long enough to engage at least one full thread pitch on the housing, the body of the carriage will be supported by the helical thread throughout 360 degrees of its cylindrical outer surface, which would effectively eliminate any tendency to catch or exhibit jerky motion, which would interrupt the smooth transition in the sounds that are produced by a squeaker device that may be positioned within the carriage.

It is noted that any suitable squeaker or noise making device that generates sounds as a result of air flow may be secured to the carriage 120 in any suitable fashion, particularly by being carried within its hollow interior.

Figure 10:
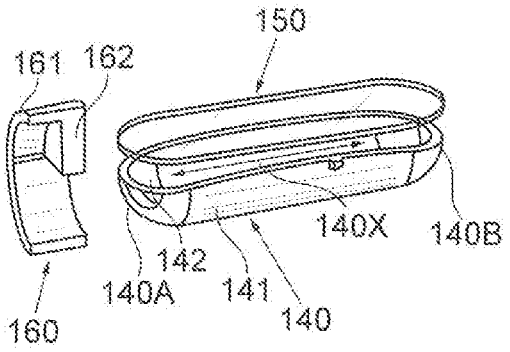
FIG. 10 is an exploded perspective view of a squeaker resonator cup, a reed, and a mounting ring that may be used in the carriage of the squeaker assembly of FIG. 2 and FIG. 5.

As seen in FIG. 10, one squeaker device that may be used may be made of a resonator cup 140, a reed 150, and a support member 160 that supports the cup and reed. The resonator cup 140 may have an elongated body formed of a curved wall that may extend along an axial direction 140X from a first end 140A to a second end 140B. As seen in FIG. 10, the curved wall of the resonator cup 140 may have an outer surface 141 and an inner surface 142, which may be an offset of the outer surface, to provide for a particular wall thickness. Both the inner surface 142 and the outer surface 141 may have a semicircular cross-sectional shape at its central portion, which semicircular cross-sectional shape may transition to quarter-spherical surfaces at the ends 140A and 140B. The curved wall may terminate on a generally flat surface, and may form a race-track shaped periphery where the ends of each of the outer surface 141 and the inner surface 142 terminate on the flat surface. The resonator cup 140 may thus resemble half of a pressure vessel, which is typically formed of a cylindrical center section with ends that are each hemispherical. The resonator cup 140 may also resemble a race track oval. That flat surface of the curved wall may extend only throughout the central portion of the cup 140, as it may transition to respective angled surfaces that may angle towards the distal ends 140A and 140B of the cup, to provide for a small gap G between the ends of the resonator cup and the reed, when the reed is mounted thereto (see e.g., FIG. 11B).

The reed 150 may have a shape that corresponds to the termination of the curved wall of the resonator cup 140 (i.e., it may have the same or a similar race track oval shape for its periphery), and may be positioned over the correspondingly shaped opening in the cup, with at least a central portion of the periphery of the reed positioned in contact with the generally flat surface of the cup. This relationship between the central portion of the periphery of the reed 150 being in contact with the generally flat surface of the resonator cup 140 may be maintained by receiving a portion thereof within the correspondingly shaped opening in the support member 160. Note that only section views showing a portion (i.e., roughly halt) of the support member 160 are illustrated within FIG. 10 (and also within FIG. 11A). Therefore, the support member 160 may be a short length of a ring-shaped member, having a continuous outer ring 161 and a flange 162, where the flange may be perpendicular to the axis of the ring, and may have an opening that is sized to hold the reed 150 and resonator cup 140 together in a friction fit.

Figure 11A:
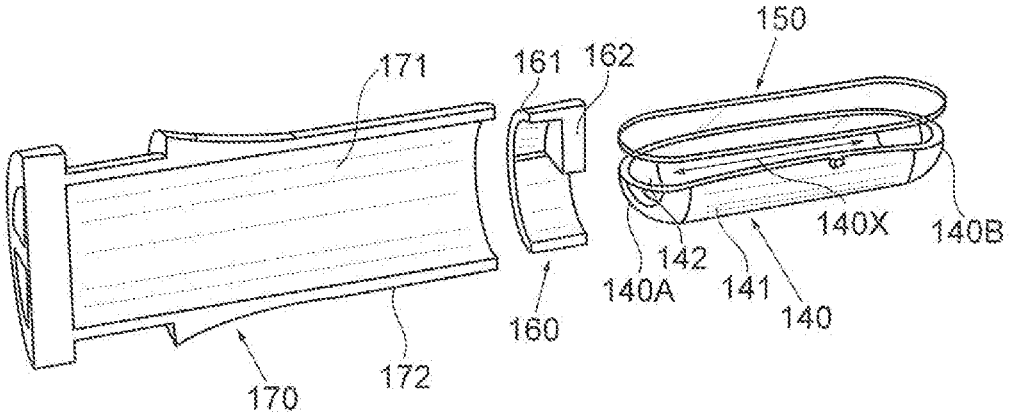
FIG. 11A is an exploded perspective view of a squeaker resonator cup, a reed, a mounting ring, and a squeaker housing that may be used in the carriage of the squeaker assembly of FIG. 2 and FIG. 5.
Figure 11B:
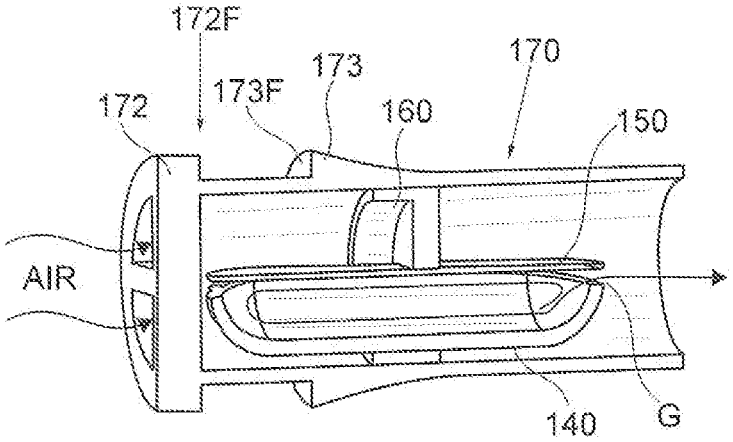
FIG. 11B is a perspective view showing the squeaker resonator cup, the reed, and the mounting ring of FIG. 11A, after being assembly for use in the carriage of the squeaker assembly shown in FIG. 2 and FIG. 5.

The reed 150 and resonator cup 140 being held together within the support member 160, as seen within FIG. 11B, using a friction fit and/or adhesive. The outer surface of the outer ring 161 of support member 160 may be cylindrical, and may be sized to fit within, and be secured to a corresponding inner cylindrical surface of the hollow carriage 120, to couple the squeaker device to the carriage (Note that other forms/shapes other than cylindrical may be used for the outer surface of the ring, and other shapes may also be used for the inner surface of the carriage 120—e.g., rectangular).

In another embodiment, shown in FIG. 11A and FIG. 11B, the outer surface of the outer ring 161 of support member 160 may be cylindrical, and may be sized to fit within a correspondingly shaped interior surface 171 of a housing 170, in either a clearance fit or a friction fit. Adhesive may be used to secure the outer ring 161 of the support member 160 to the squeaker housing 170, particularly where a clearance fit is used.

Figure 8:
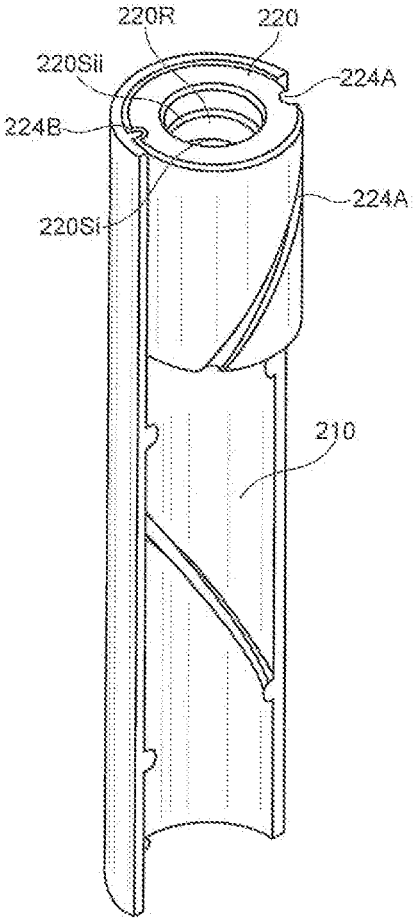
FIG. 8 is a cut-away perspective view of the housing of the squeaker assembly of FIG. 7, showing the carriage mounted therein.
Figure 9:
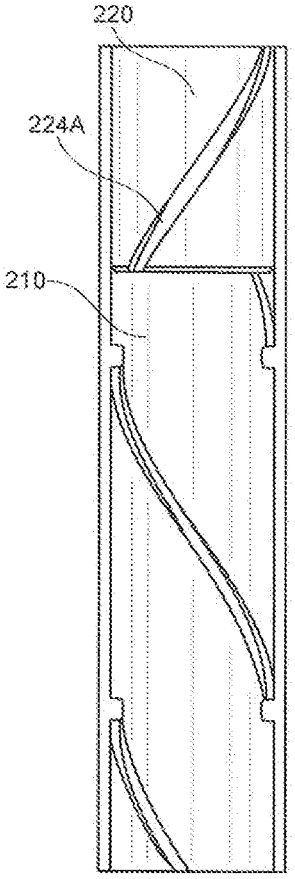
FIG. 9 is a cut-away front view of the housing of the squeaker assembly of FIG. 7, showing the carriage mounted therein.

The housing 170 may then be secured to the carriage 120, using adhesive, etc. Rather than using adhesive and/or a friction fit, the housing 170 may be be formed to have a conical ramp 173 that may terminate in a flat surface 173F, and may also have a head 172 with a flat surface 172F that may be parallel to, but offset from the flat surface 173F of the ramp 173 a distance. The distance may correspond to the extent of an annular ring 220R protruding into the hollow interior of the carriage 220, as seen in FIG. 8, to permit sliding coupling of the housing 170 of the squeaker device to the carriage, with the sides 220Si/220Sii of the annular ring 220R becoming nested between the flat surface 173F and the flat surface 172F As a result of such sliding.

With any particular squeaker device (i.e., the reed 150, resonator cup 140, and support member 160) being secured within the carriage 120, when air flows in a first direction through the housing 110 of the sound producing device 100, the squeaker device emits sound, and the squeaker carriage is driven to track along the helical thread 114, causing the carriage to rotate and to also translate in the first direction, with such rotation and translation being according to a pitch of the helical thread. A frequency of the sound produced by the squeaker changes according to the carriage's translational movement, as such movement changes the dimensions of the sound-producing chamber.

In general, when the carriage 120 tracks toward a distal end of the housing 110 away from the air source (e.g., in the first direction being away from an air-filled bladder 99 shown in FIG. 1), such movement enlarges the size of the sound producing chamber causing the frequency of the sound produced to become increasingly lower.

Similarly, when the carriage tracks toward the air source (e.g., in the second direction being increasingly closer to the air-filled bladder), such movement decreases the size of the sound producing chamber causing the frequency of the sound produced to become increasingly higher.

The interior surface 113 of the housing 110 is preferably a cylindrical surface, and the exterior surface 125 of the squeaker carriage 120 is also preferably a cylindrical surface that is particularly sized to slide with respect to the cylindrical interior surface of the housing. The cylindrical exterior surface 125 of the squeaker carriage 120 may be particularly sized to slide with respect to the cylindrical interior surface 113 of the housing 110 in a loose clearance fit (i.e., a free running fit), or may slide respect to the cylindrical interior surface 113 of the housing 110 using a close clearance fit. Alternatively, a very slight friction fit may be used therebetween, which friction fit may be so slight as to not prohibit movement of the carriage by the air pressure that is normally produced by the air source of the toy in which the sound producing device 100 is installed. A closer fit between the exterior surface 125 of the squeaker carriage 120 and the interior surface 113 of the housing 110 may serve to reduce leakage of air therebetween that may otherwise be used to propel the carriage or to produce a larger volume of sound from the squeaker.

A second sound producing device 200 is shown in FIGS. 5-9, which may be formed similar to the sound producing device 100, except that its housing 210 may have a cylindrical interior surface from which may protrude a first helical tracking thread 214A and a second helical tracking thread 214B, such that the two threads form a pair of parallel helices intertwined about a common axis (i.e., they form a double helix). The carriage 220 of the sound producing device 200 may have corresponding first and second openings in its exterior surface defining a first helical shaped recess 224A and a second helical shaped recess 224B that receive and track along the first and second helical housing threads 214A'214B.

The double helix arrangement provides very stable symmetric support for the carriage 220 that does not have a tendency to hang up, even for much shorter carriage lengths.

While illustrative implementations of one or more embodiments of the disclosed apparatus are provided hereinabove, those skilled in the art and having the benefit of the present disclosure will appreciate that further embodiments may be implemented with various changes within the scope of the disclosed apparatus. Other modifications, substitutions, omissions and changes may be made in the design, size, materials used or proportions, operating conditions, assembly sequence, or arrangement or positioning of elements and members of the exemplary embodiments without departing from the spirit of this invention.

Accordingly, the breadth and scope of the present disclosure should not be limited by any of the above-described example embodiments, but should be defined only in accordance with the following claims and their equivalents.

What is claimed is:

1. A sound-producing device for a toy, said sound-producing device comprising:

a housing, said housing comprising an opening defining an interior surface of a cavity with internal threading formed on said interior surface, said internal threading on said interior surface consisting of one helical-shaped tracking thread protruding therefrom;

a carriage, an opening in an exterior surface of said carriage defining a helical shaped recess configured to receive and track along said helical-shaped tracking thread on said interior surface of said housing; said carriage comprising an opening configured to receive a squeaker device therein; and wherein when air is caused to flow in a first direction through said housing, said carriage moves according to a pitch of said helical-shaped tracking thread of said housing, changing a frequency of sound produced by the squeaker device in accordance with said movement.

2. The sound-producing device according to claim 1, wherein said movement of said carriage according to a pitch of said helical tracking thread of said housing causes said carriage to rotate, and to also translate in the first direction, according to said pitch of said helical thread.

3. The sound-producing device according to claim 2, wherein when air is caused to flow in a second direction through said housing, said carriage moves in the second direction according to said pitch of said helical tracking thread, changing the frequency of sound produced by the squeaker device.

4. The sound-producing device according to claim 3, wherein said interior surface of said housing comprises a cylindrical surface.

5. The sound-producing device according to claim 4, wherein an exterior surface of said carriage comprises a cylindrical surface.

6. The sound-producing device according to claim 5, wherein said cylindrical exterior surface of said carriage is sized to slide with respect to said cylindrical interior surface of said housing in a close clearance fit.

7. The sound-producing device according to claim 5, wherein said cylindrical exterior surface of said carriage is sized to slide with respect to said cylindrical interior surface of said housing in a free running fit.

8. A sound-producing device for a toy, said sound-producing device comprising:

a housing, said housing comprising an interior surface with a first helical-shaped tracking thread and a second helical-shaped tracking thread protruding therefrom;

a carriage, a first opening in an exterior surface of said carriage defining a first helical shaped recess configured to receive and track along said first helical-shaped tracking thread, and a second opening in the exterior surface of said carriage defining a second helical shaped recess configured to receive and track along said second helical-shaped tracking thread; said carriage comprising an opening configured to receive a squeaker device therein; and wherein when air is caused to flow in a first direction through said housing, said carriage moves according to a pitch of said first and second helical tracking threads of said housing, changing a frequency of sound produced by said squeaker device in accordance with said movement.

9. The sound-producing device according to claim 8, wherein said movement of said carriage according to a pitch of said helical tracking threads of said housing causes said carriage to rotate, and to also translate in the first direction, according to a pitch of said helical thread.

10. The sound-producing device according to claim 9, wherein when air is caused to flow in a second direction through said housing, said carriage moves in the second direction according to said pitch of said helical tracking thread, changing the frequency of sound produced by said squeaker device.

11. The sound-producing device according to claim 10, wherein said interior surface of said housing comprises a cylindrical surface.

12. The sound-producing device according to claim 10, wherein an exterior surface of said carriage comprises a cylindrical surface.

13. The sound-producing device according to claim 11, wherein said cylindrical exterior surface of said carriage is sized to slide with respect to said cylindrical interior surface of said housing in a close clearance fit.

14. The sound-producing device according to claim 5, wherein said cylindrical exterior surface of said carriage is sized to slide with respect to said cylindrical interior surface of said housing in a free running fit.

* * * * *